US006076859A

United States Patent [19]

Hall et al.

[11] Patent Number: 6,076,859

[45] Date of Patent: Jun. 20, 2000

[54] METHOD AND LABEL SYSTEM FOR MARKING PROPERTY

[75] Inventors: Dee Anne Hall, Aliso Viejo, Calif.; Gilbert W. McGuff, Rutheron, N. Mex.

[73] Assignee: Express Systems Incorporated, Irvine, Calif.

[21] Appl. No.: 09/088,351

[22] Filed: Jun. 1, 1998

[51] Int. Cl.[7] ..... B42D 15/00

[52] U.S. Cl. ..... 283/89; 283/70

[58] Field of Search ..... 283/72, 88, 89, 283/91, 92, 74, 113, 117

[56] References Cited

U.S. PATENT DOCUMENTS

| | | | |
|---|---|---|---|
| 2,162,456 | 6/1939 | Kriegea et al. | 283/89 X |
| 2,330,718 | 9/1943 | Kallmann | 283/89 X |
| 4,881,217 | 11/1989 | Ohki | 283/89 X |
| 4,976,456 | 12/1990 | Jack | 283/70 |
| 4,987,287 | 1/1991 | Jack | 219/121.69 |
| 5,151,572 | 9/1992 | Jack | 219/121.39 |
| 5,401,960 | 3/1995 | Fisum et al. | 283/89 X |

*Primary Examiner*—Willmon Fridie, Jr.
*Attorney, Agent, or Firm*—Loeb & Loeb, LLP

[57] ABSTRACT

A method especially useful for marking property having a multitude of individually-valuable metal components involves adhering at least one specially-constructed label to at least one painted metal surface of the property to be marked. Each label includes a thermal label stock layer having information relating to the marked property imprinted on one side and a non-release thermal adhesive layer coated on another side. The label is impregnated with a chemical which is visible only when exposed to ultraviolet light and has apertures therethrough forming identifying indicia at a predetermined location, such as a personal identification number unique to the property owner, and/or a bar code imprinted thereon containing the identifying indicia. A durable topcoat on the label provides a protective seal. After the label is adhered to the metal surface, the ultraviolet-visible chemical migrates to substrata thereof. The identifying indicia can be observed by scanning the bar code while the label is adhered to the metal surface. If the label is removed, the identifying indicia can still be observed by exposing the metal surface to ultraviolet light, rendering visible the ultraviolet-visible chemical and outlining the identifying indicia on the metal surface. A label system for marking property using the above-noted method and a method for making the label system are also disclosed.

36 Claims, 6 Drawing Sheets

METHOD AND LABEL SYSTEM FOR MARKING PROPERTY

BACKGROUND OF THE INVENTION

1. Field of the Invention

The present invention relates to a label and label system for marking property, as well as to methods for making and using such a label and label system, and more particularly to a label and label system well-suited to marking and identifying property. The marking system is particularly well-suited to marking property characterized by a multiplicity of separable and individually-valuable components, such as cars and sophisticated medical equipment. The label and label system is capable of insuring the retention of identifying indicia on the property, and on selected components thereof, even after a physical label identifying the property has been removed.

2. Description of the Related Art

Thievery has existed since time immemorial. Attempts have been made not only to protect premises housing property from uninvited intrusion, but also to mark and identify valued property directly in an effort to discourage its theft. In this regard, evolving methods of stealing property have led to a corresponding need for increasingly-creative approaches to marking, identifying and protecting such property.

One classic and profitable area of focus for thieves is automobiles. Often left outside, cars are especially vulnerable to theft and present particularly worrisome concerns. Moreover, not only the car itself, but also the individual and expensive components of the car, provide a particularly lucrative arena for the modern thief. An automobile can be stolen and, in a matter of hours, be completely disassembled and its parts scattered in various directions for sale to those who deal in stolen goods. The difficulty of tracking parts once a stolen car has been disassembled is intractable. Nevertheless, attempts have been made to accomplish the task.

The most basic system for marking automobiles is the well-known vehicle identification number, or "VIN," a unique alphanumeric character sequence assigned to each new automobile by its manufacturer. The VIN is generally provided on a metal plate attached to the dashboard of the vehicle, and/or to other parts of the auto such as the engine block or rear axle. Such a strategy for marking cars is most useful for identifying the car as a whole, versus its individual parts, and is of limited usefulness. Indeed, the metal plate bearing the VIN can be successfully removed, or the VIN may be ground off or otherwise obliterated from the surface of the metal plate.

Accordingly, so-called "after-market" marking systems for automobiles have been proposed. An "after-market" marking system refers to a system for marking vehicles which can be implemented relatively easily not only by car manufacturers, but also by car dealerships, car repair facilities, service stations and automobile owners themselves. Conversely, VIN marking system installation in cars is conventionally performed solely by auto manufacturers.

U.S. Pat. No. 4,976,456 to Jack discusses an after-market automobile marking system in which an adhesive label is attached to a chosen automobile part. The label, a plastic film, has a predetermined number, or other desired indicia such as the VIN, impressed to a desired depth as colorless physical depressions in the film's surface, using a dot matrix or line printer without its associated ink or visible marking means. The absence of coloration makes the physical depressions substantially invisible to a casual observer and only observed by careful scrutiny. The label upon which the physical impressions are made may be clear or provided with a mottled surface to render its location difficult to discover. When a vehicle bearing such a label is suspected of being stolen, colorant from a marking pen or graphite pencil is applied over the surface of the label and the colorant then wiped away, leaving a residue of color in the physical depressions which renders them, and hence the impressed indicia, visible on the label. Alternatively, the patent suggests impressing the physical depressions directly on an article to be marked.

Such a system is disadvantageous in that removal of the label, which contains the invisible indicia identifying the part, makes it impossible to identify the origin of the part any longer. Additionally, such markings can actually be detected by the careful observer and obliterated. Moreover, the alternative suggestion to physically depress indicia into the part itself is limited in that it marginally deforms and permanently mars the part, is only usable on parts having suitable surfaces capable of being easily physically-depressed, and requires application by a skilled professional, thus rendering use of the system by the average property owner impossible and impractical.

Other marking systems for permanently marking component parts of property such as automobiles are known, such as those systems described in U.S. Pat. Nos. 4,987,287 and 5,151,572 to Jack. These patents disclose marking systems wherein a stencil of the indicia such as the VIN is releasably applied to a glass surface such as a car window, followed by etching of the indicia into the glass surface using the stencil and removal of the stencil from the glass surface after etching. These patents further suggest the use, apparently in conjunction with such a glass etching system, of a label having an adhesive layer incorporating a pigment. When the label is provided on a surface to be marked, the pigment transfers to the surface. The label is then removed, leaving the pigment behind so that the pigment outlines the marking in the glass. Most preferably, the pigment is visible only under ultraviolet light.

Such prior art systems find their primary utility in marking glass components of property and are not capable of permanently marking the much more numerous metal component parts of property such as automobiles. These systems also result in visible markings which mar the property, are detectable and can be obliterated by the diligent thief. Finally, such sophisticated systems cannot be implemented practically by the property owner and reliance must be placed on experts for installation.

Moreover, such marking systems are narrowly focused on theft prevention and recovery of stolen merchandise. While there is considerable interest in such a theft prevention marking system, this narrow focus limits the implementation of such marking systems. It is desirable to provide a more flexible marking system having a broader range of utility. Such a more flexible marking system could find wider application, making the provision of desirable support infrastructure for the marking system more economically reasonable.

Accordingly, the need still exists for a marking system which will not only guarantee retention of desired identifying information on valuable property having a multitude of individually-valuable parts, such as an automobile VIN on a vehicle component part, but which also can be readily utilized and installed in the after-market by retailers, repair facilities and, most importantly, directly by the property owner or lessor.

SUMMARY OF THE PREFERRED EMBODIMENTS

An object of the present invention is to provide a method for marking personal property, and more particularly a method for marking personal property having a multiplicity of individually-valuable component parts, for inventory-tracking and anti-theft purposes.

A further object of the present invention is to provide a label system, and a method for making a label system, for marking such personal property.

Yet another object of the present invention is to provide a label system for marking personal property having multiple levels of identification.

Still another object of the present invention is to provide a label system for marking personal property which eliminates the disadvantages and limitations of the prior art.

These and other objects are attained in accordance with certain aspects of the present invention by a method for marking property having at least one painted or coated surface comprising adhering at least one label to at least one painted or coated surface of the property to be marked, each label comprising a thermal adhesive-backed label impregnated with a chemical visible only when exposed to ultraviolet light and having apertures therethrough forming identifying indicia at a predetermined location, the identifying indicia relating to the marked property; and allowing the ultraviolet-visible chemical to migrate to substrata of the painted or coated surface, whereby the identifying indicia can be observed on the painted or coated surface should the label be removed therefrom by exposing the painted or coated surface to ultraviolet light, thereby rendering visible the ultraviolet-visible chemical and outlining the identifying indicia on the painted or coated surface.

In accordance with yet other aspects of the present invention, there is provided a method for marking property having at least one painted surface comprising adhering at least one label to at least one painted surface of the property, each label comprising a thermal adhesive-backed label having a bar code containing information relating to the property to be marked imprinted on a front side thereof, the label being impregnated with a composition visible only when exposed to ultraviolet light; and allowing the ultraviolet-visible composition to migrate to substrata of the painted surface, whereby the information can be detected by scanning the bar code while the label is adhered to the painted surface and thereafter the ultraviolet-visible composition can be detected on the painted surface should the label be removed from the painted surface by exposing the painted surface to ultraviolet light.

Further in accordance with another aspect of the present invention, there is provided a label system for marking property and a method for making the label system. The method for making the label system for marking property comprises providing a label sheet impregnated with a chemical visible only when exposed to ultraviolet light, the label sheet being composed of two discrete elements, a label element comprising a thermal adhesive-backed label layer having a bottom side coated with a non-release thermal adhesive layer and a backing element comprising a backing layer releasably-securing the label element thereto; creating apertures from a top side through the bottom side of the label element at a plurality of predetermined locations on the label element to remove portions of the label element and the ultraviolet-visible chemical and form identifying indicia through the label element, and/or imprinting the top side of the label element with a plurality of bar codes containing information relating to the property to be marked; and dividing the label layer into a plurality of discrete labels releasably-secured to the backing element, each label containing thereon the identifying indicia and/or the bar code.

In a preferred aspect of the present invention, each label of the label system includes both identifying indicia apertures formed therethrough and a bar code containing information relating to the property to be marked.

In an especially preferred aspect of the present invention, the identifying indicia formed by the apertures on the label is a personal identification number unique to the owner of the marked property.

In another preferred aspect of the present invention, the bar code imprinted on the label contains this unique personal identification number.

In still another preferred aspect of the present invention, a durable topcoat is applied to the front side of the label to provide a protective seal for the label, preferably including the identifying indicia apertures.

In yet another preferred aspect of the invention, the thermal adhesive-backed label is made of a label stock having a non-release adhesive on its rear side and a moisture-resistant and chemical-resistant liner laminated to its front side.

In an exemplary preferred aspect of the present invention, the label system is a group of ten labels releasably-attached to the backing element of the label system, each label having the unique personal identification number formed therethrough and encoded in the bar code, for adhering to the painted metal surfaces of individually-useful component parts of valuable property such as automobiles and leased medical equipment.

BRIEF DESCRIPTION OF THE DRAWINGS

The present invention will now be described in conjunction with the accompanying drawings, in which.

DETAILED DESCRIPTION OF THE PREFERRED EMBODIMENTS

A first embodiment of a label system for marking property in accordance with the present invention is shown in FIGS. 1 to 4.

Figure 1:
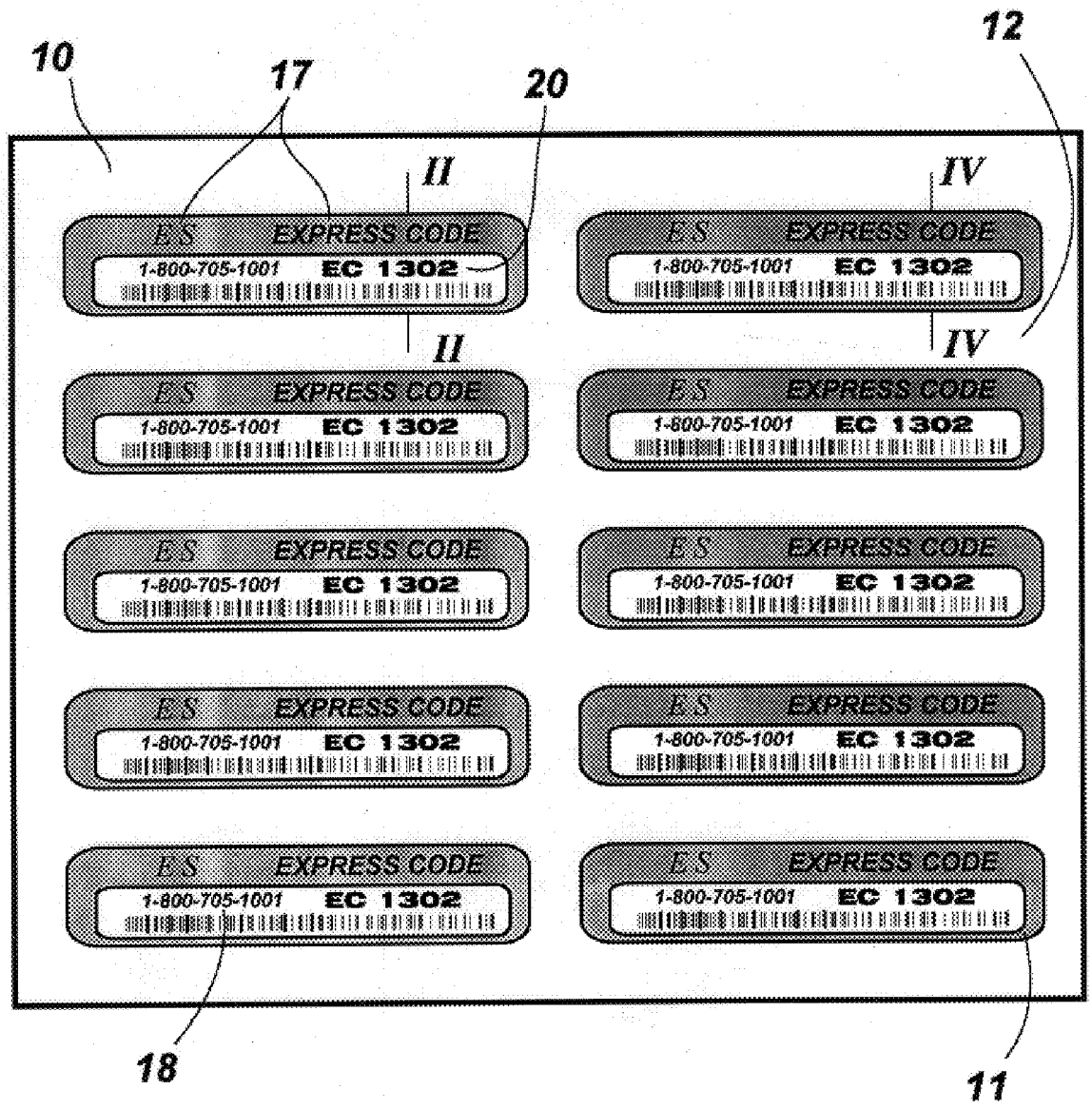
FIG. 1 is a plan view of a first embodiment of a label system prior to use made in accordance with a method of the present invention.
Figure 2:
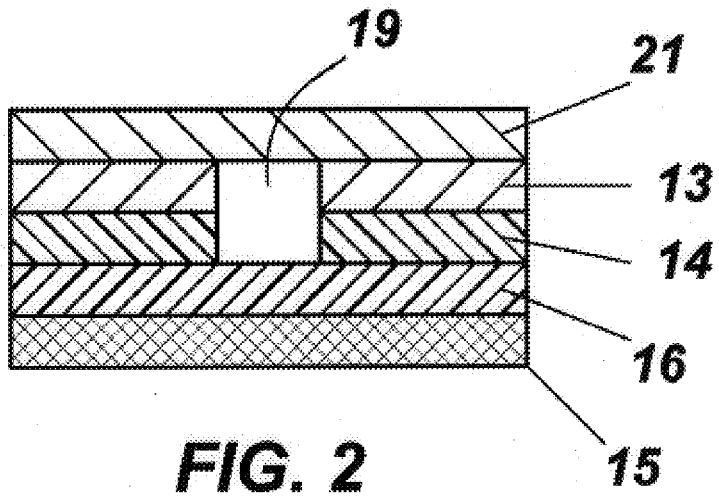
FIG. 2 is an enlarged cross-sectional side view of the FIG. 1 label system, taken along the line II—II of FIG. 1.
Figure 3:
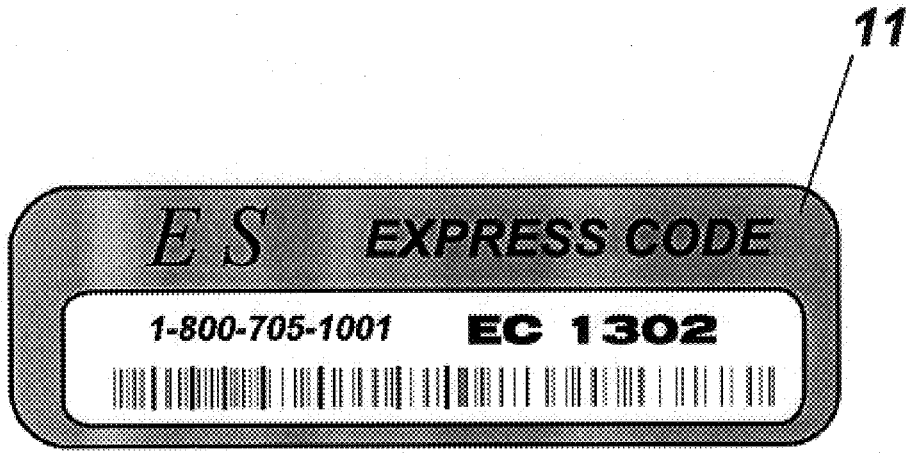
FIG. 3 is a plan view of a label separated from the label system of FIG. 1.
Figure 4:
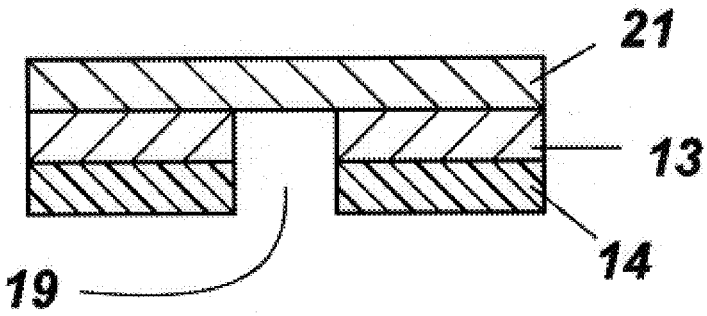
FIG. 4 is an enlarged cross-sectional side view of the FIG. 3 label, taken along the line IV—IV of FIG. 3.

As shown in FIG. 1, a label system, generally denoted at 10, has ten labels 11 releasably-mounted on a backing element 12 for supporting and storing labels 11 prior to use. Each label 11, as shown in FIGS. 3 and 4, includes a thermal label stock layer 13, which has a non-release thermal adhesive 14 on its rear side, and is impregnated with a compound that is visible only when exposed to ultraviolet light. As shown in FIG. 2, the backing element 12 includes a backing 15 having, for example, a conventional release coating 16 on its surface.

Imprinted on each label stock layer 13 is information 17,18 visibly identifying, for instance, the company monitoring use of the label system. Apertures 19 formed completely through label stock layer 13 and adhesive 14 create a unique alphanumeric sequence 20, here "EC 1302," for identifying the marked property and its owner. A top coating 21 provides a protective seal for the label, including apertures 19.

Preferably, label stock layer 13 is laminated to a moisture-resistant and thermal-resistant liner. In this construction, the apertures 19 are also formed through the liner, as well as through label stock layer 13 and adhesive layer 14, to completely perforate the materials constituting the label. A preferred but merely exemplary label is available commercially from Avery Dennison. The label is composed of a thermal paper stock having N48 adhesive thereon, contains ultraviolet migrating additives, and is laminated to a liner composed of 78# to 93# double polycoate liner. The backing element may comprise any conventionally-known backing sheet for releasably-securing labels thereto.

A preferred topcoat film is a moisture-resistant, chemical-resistant and ultra clear polymer material capable of providing a lay fiat, anti-curling, super clear film having a glossy finish. A particularly preferred topcoat film is made of polypropylene. The topcoat film overlays the entire label, including the area of the label which has been completely penetrated to form the identifying indicia apertures.

Any conventional laser scribing or writing apparatus which is capable of burning through paper and plastic material can be used in the present invention for laser scribing the identifying indicia, e.g., an alphanumeric set, through the label material. A suitable laser scribing apparatus is supplied, for example, by Irvine Spectrum Printing. Such a laser scribing apparatus can create the alphanumeric set in a specific font style to assist in the correct and advantageous removal of the label and maximize human readability. The customized laser font advantageously accepts paper material removal from the cut label.

Ultraviolet light-emanating devices to illuminate material visible only under ultraviolet light are known in the art. Such a device is exemplified by the 1191 UV Fluor Lite Model available commercially from Bright Star Industries.

A second embodiment of a label system for marking property in accordance with the present invention is shown in FIGS. 5 to 8.

Figure 5:
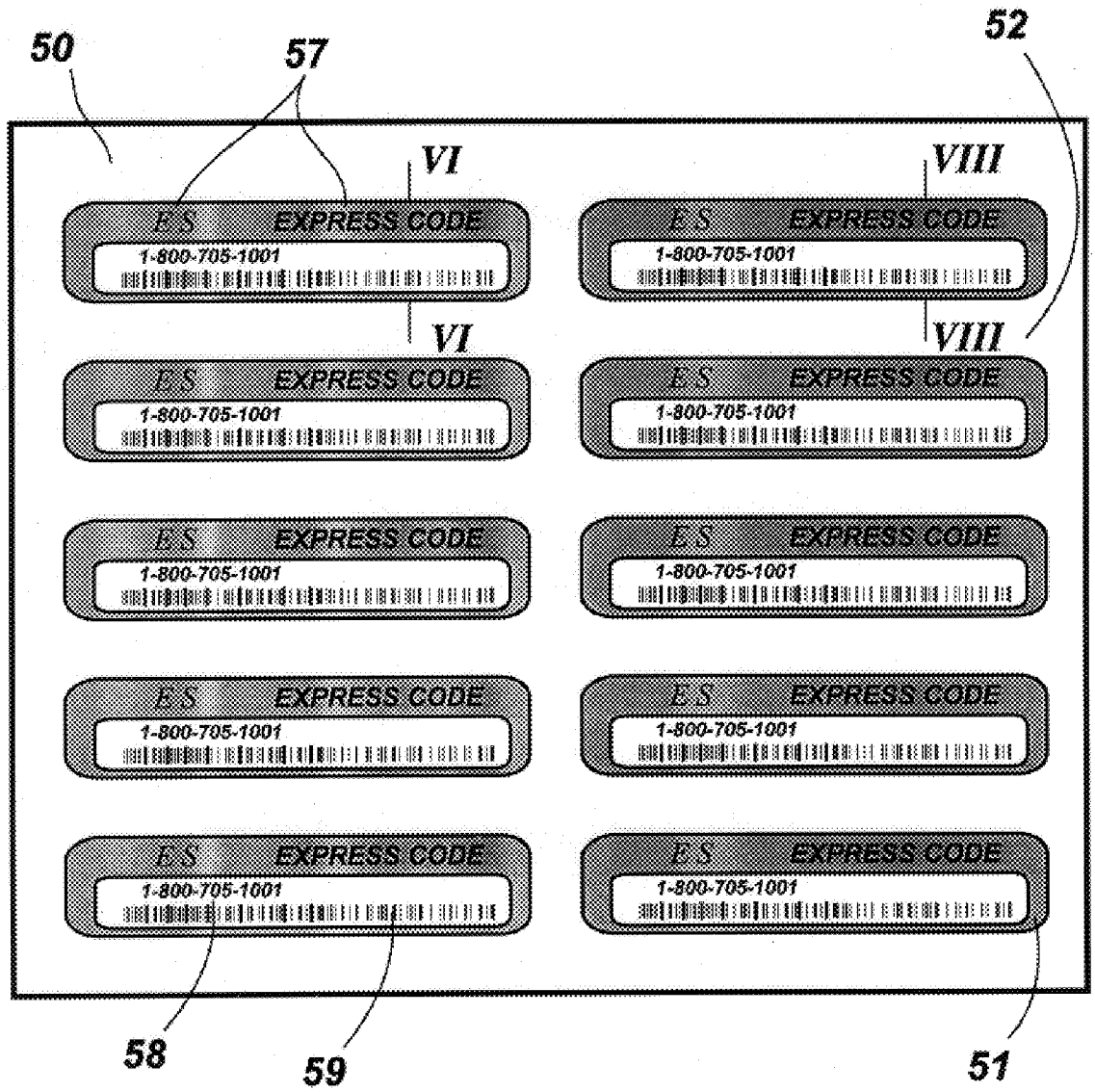
FIG. 5 is a plan view of a second embodiment of a label system prior to use made in accordance with a method of the present invention.
Figure 6:
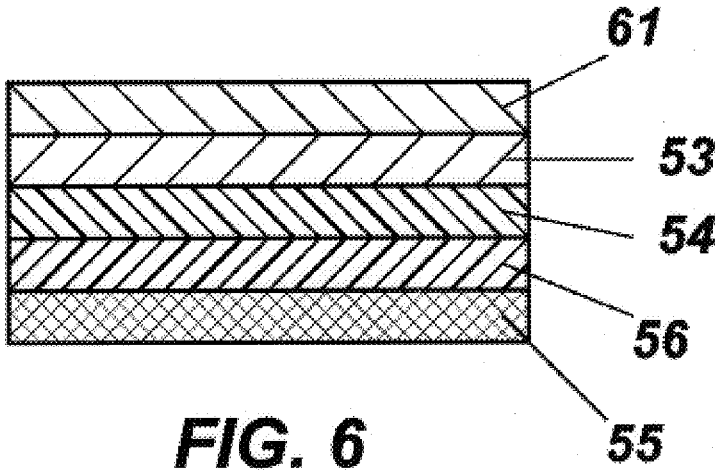
FIG. 6 is an enlarged cross-sectional side view of the FIG. 5 label system, taken along the line VI—VI of FIG. 5.
Figure 7:
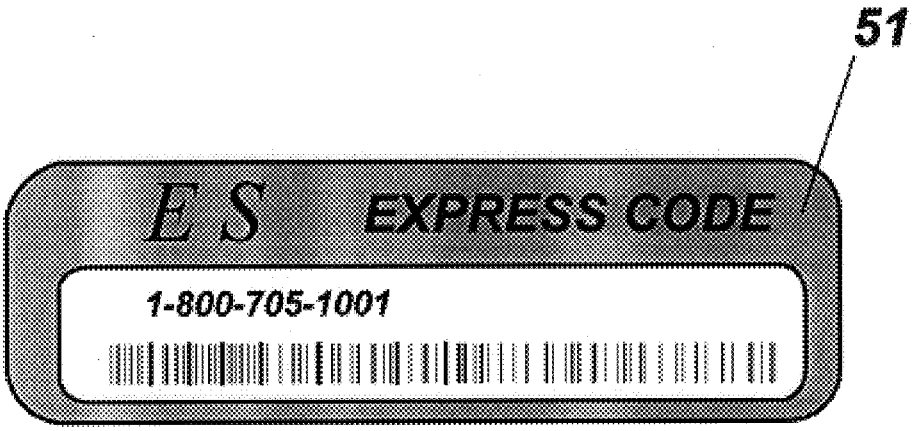
FIG. 7 is a plan view of a label separated from the label system of FIG. 5.
Figure 8:
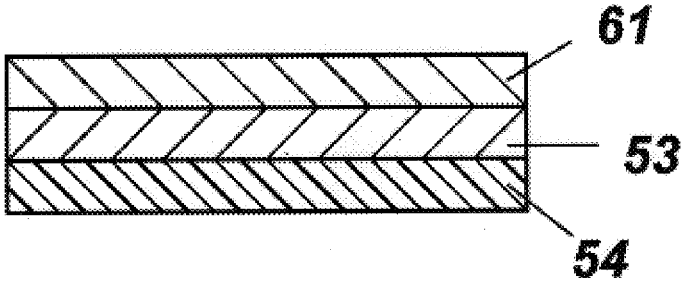
FIG. 8 is an enlarged cross-sectional side view of the FIG. 7 label, taken along the line VIII—VIII of FIG. 7.

As shown in FIG. 5, a label system, generally denoted at 50, has ten labels 51 releasably-mounted on a backing element 52. As observed most readily in FIGS. 7 and 8, each label 51 includes a thermal label stock layer 53 which has a non-release thermal adhesive 54 on its rear side. Each label 51 is impregnated with a compound or compounds visible only when exposed to ultraviolet light. As shown in FIG. 6, the backing element 52 includes a backing 55 having a conventional release coating 56 on its surface.

As in the first embodiment, it is preferred to laminate label stock layer 53 to a moisture-resistant and thermal-resistant liner material to provide additional durability to the label.

Each label stock layer 53 has imprinted thereon information 57,58 visibly identifying, for example, a company monitoring use of the label system. A bar code 59 is also imprinted on each label stock layer 53. Bar code 59 contains coded information which can be scanned, such as the unique alphanumeric sequence "EC 1302," to identify marked property and its owner. A top coating 61 provides a protective seal for the label, including bar code 59.

The bar code of the present invention can be imprinted on the label using known laser printing techniques. A preferred laser printing technique utilizes a high density laser printer, such as the commercially-available Xante 8200 laser printer. The bar coding of the present invention may, for example, employ one or more of 19 known and commercially-available formats in a high density format.

A particularly preferred bar code useful in the present invention is formulated in Code 39, which is the most common known bar coding format. An example of such a bar code possesses the following characteristics:

Code 39 (3 of 9) format
1200 dpi resolution
Bar width reduction=two pixels
Magnification (Scale) 50%
Bar height=36
Symbol width=4.31996
Wide to narrow ratio=2.0 to 1.0
No check digit; and
Non-human readable.

A third embodiment of a label system for marking property according to the present invention is illustrated in FIGS. 9 to 12.

Figure 9:
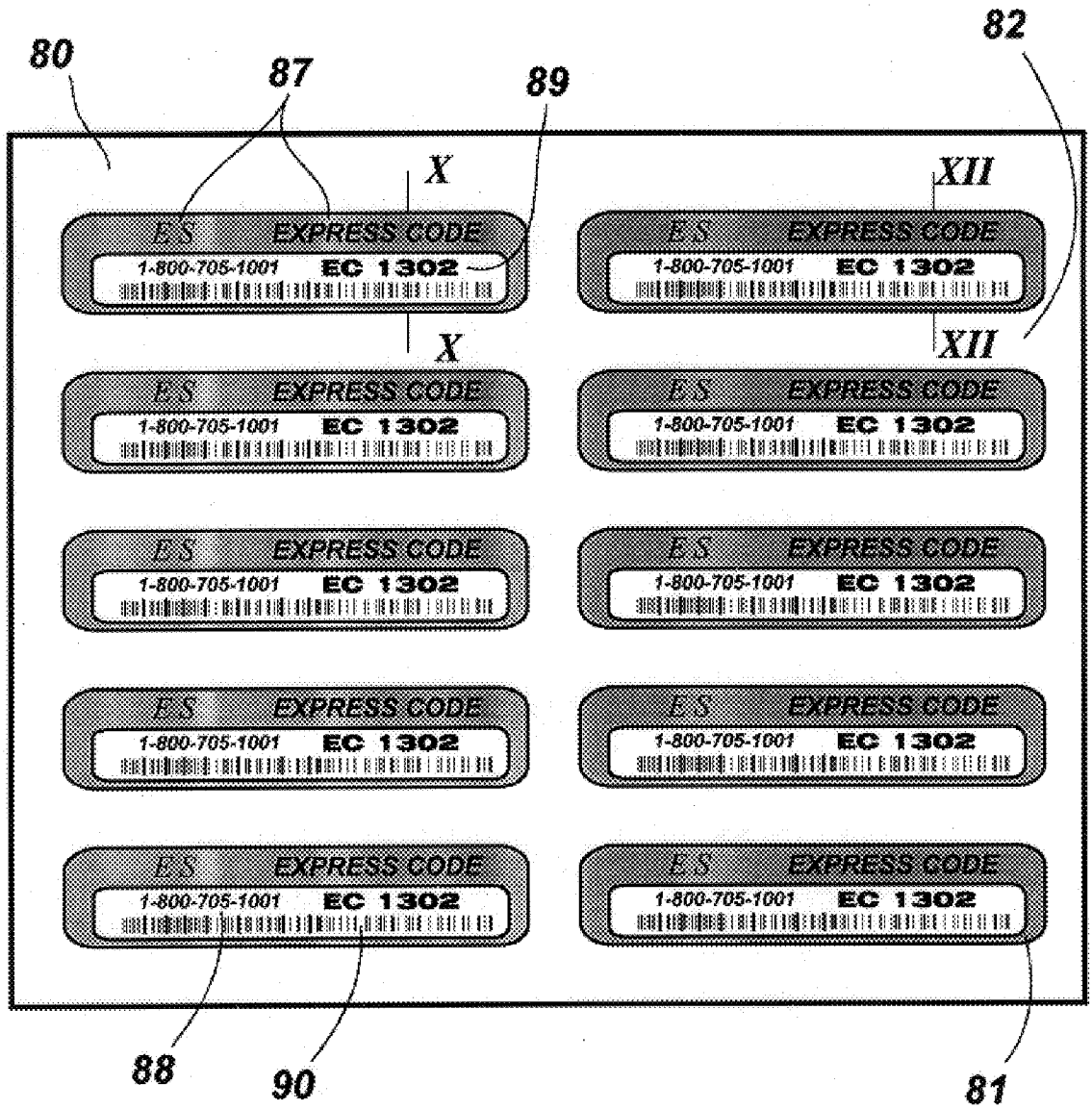
FIG. 9 is a plan view of a third embodiment of a label system prior to use made in accordance with a method of the present invention.
Figure 10:
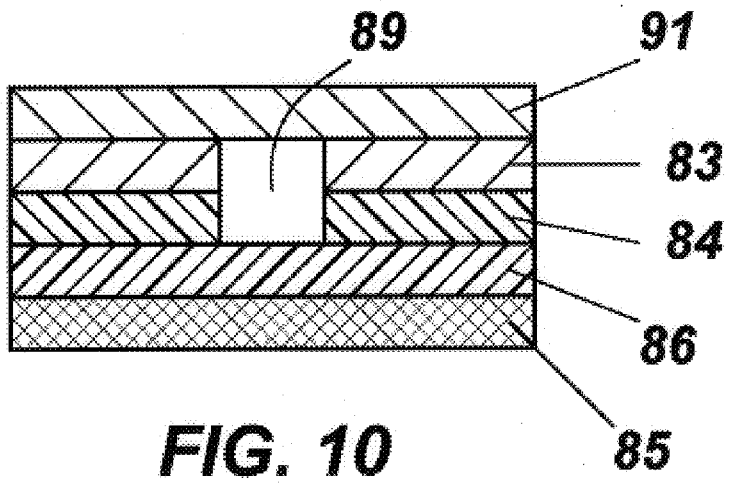
FIG. 10 is an enlarged cross-sectional side view of the FIG. 9 label system, taken along the line X—X of FIG. 9.
Figure 11:
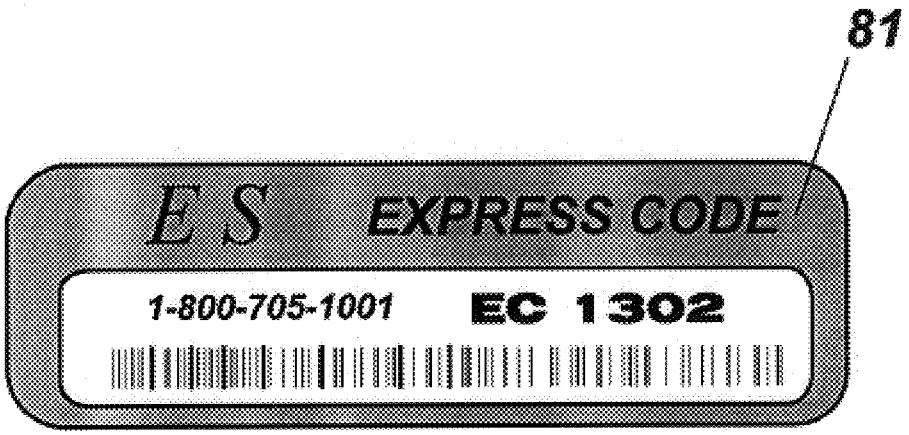
FIG. 11 is a plan view of a label separated from the label system of FIG. 9.
Figure 12:
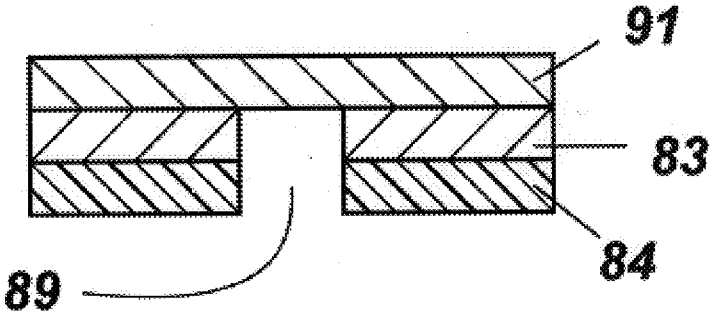
FIG. 12 is an enlarged cross-sectional side view of the label, taken along the line XII—XII of FIG. 11.

In FIG. 9, a label system generally denoted at 80 has ten labels 81 releasably-mounted on a backing element 82. Each label 81 includes a thermal label stock layer 83 which has a non-release thermal adhesive 84 on its rear side. The label 81 is impregnated with a composition that is visible only when exposed to ultraviolet light. Backing element 82 includes a backing material 85 having a conventional release coating 86 on its surface. Imprinted on each label stock layer 83 is information 87,88 visibly identifying the company monitoring use of the label system. Apertures 89 formed completely through label stock 83 and adhesive 84 create the unique alphanumeric sequence "EC 1302" for ultimately identifying the marked property and its owner. Also imprinted on label stock 83 is a bar code 90 containing coded information which, when scanned, identifies the marked property by the unique alphanumeric sequence. A top coating 91 provides a protective seal for the label, including apertures 89 and bar code 90.

Many aspects of the present invention will now be illustrated in the following Example, which exemplifies the methods of manufacture and use of the invention in conjunction with a national registry system intended to monitor vehicles employing one or more aspects of the invention.

EXAMPLE

The method and label system of the present invention can be employed as part of a national system of deterrence against vehicle theft.

A label sheet made of specific materials is provided for processing in accordance with various preferred aspects of the invention. The label sheet is obtained from Avery Dennison. The label sheet includes a thermal paper stock having N48 adhesive thereon and UV migrating additives therein. The thermal paper stock is laminated to a liner composed of 78# to 93# double polycoate liner. The label sheet is releasably-secured to a conventional backing element.

In the Example, ten labels are to be prepared on ten predetermined and spaced-apart symmetrical locations on the label sheet.

The label sheet is first subjected to conventional ink impregnation to imprint the label sheet, at each label location, with information including the trademark of the company providing the marking system, here "ES Express Code," and the phone number of the company, here Express Systems. A Code 39 bar code is then imprinted at each label location on the label sheet using a Xante 8200 laser printer in a high density format to the following specifications:

Code 39 (3 of 9) format 1200 dpi resolution

Bar width reduction=two pixels

Magnification (Scale) 50%

Bar height=36

Symbol width=4.31996

Wide to narrow ratio=2.0 to 1.0

No check digit; and

Non-human readable.

Each imprinted bar code contains the company name and phone number, as well as a unique personal identification number (PIN), here "EC 1302," which will become unique to the ultimate purchaser and the specific property to which the labels are applied.

Following bar coding, each label location on the label sheet has the PIN EC 1302 burned through the liner, thermal label stock and adhesive using a laser printer obtained from Irvine Spectrum Printing. The PIN is created in a specific, customized font style to assist in the correct removal of paper material from the cut label to facilitate human readability.

A polypropylene topcoat available from 3M is then applied by conventional means as a protective seal for each label, including the apertured PIN EC 1302. The label sheet is die-cut to provide 10 discrete labels symmetrically and releasably-secured to the backing element, each label containing the ink-imprinted company contact information, a bar code containing both the company contact information and the unique PIN, and the laser-etched customized PIN formed completely therethrough, all protected by the polypropylene topcoat. Extraneous label sheet material which is created during the die-cut operation is removed or "weeded out" by conventional means.

The labels are removed from the backing element and affixed to 10 specifically preferred painted metal surfaces of a car, including the doorjambs, engine well, quarter panels, and unobtrusive surfaces of the hood and trunk. The UV additives migrate into the painted metal surface and react therewith. Due to its construction, the applied label is resistant to heat, moisture and chemicals and extremely difficult to remove.

The property and its owner are identified by scanning the bar code on the label to retrieve bar-coded information, including the unique PIN. If the label is inadvertently or intentionally removed, the property and its owner can still be identified by exposing the surface where the label once resided to ultraviolet light, whereupon the LW-visible material reveals itself, outlining the PIN on the painted surface previously located beneath the apertures in the label, an area bereft of UV-visible material due to the prior absence of any impregnated label material thereover.

In a preferred implementation of the present invention, at the time of purchase of the label system, either from a car dealership or the most recent seller of the vehicle, a registration form is filled out by the purchaser and sent to Express Systems. System user and vehicle information are entered in a national database. Certain of this information, such as the customer name, vehicle VIN, car model and year, and unique PIN, are also supplied to the National Insurance Crime Bureau for easy access by crime enforcement officials.

The present invention can combine bar code technology and ultraviolet "footprinting" in a single property marking system to preferably provide a three level system of identification. At the first level, a printed label contains visible information on the monitoring company and the unique customer identification number. At the second level, the bar code identifies, when scanned, similar information to that visible on the label at the first level. Finally, at the third level, if the label is removed, the unique customer identification number is left behind in an invisible and indelible ink which cannot be viewed by the naked eye, but only read under ultraviolet light. All this is achieved without physically deforming or damaging the marked property in any visible manner.

It will thus be readily appreciated that the present invention can be employed to manufacture a highly deterrent label system that can be used to identify and protect a vast array of goods in a wide variety of circumstances and locations, including the home, office, warehouse, retail establishment, or anywhere outside. The present invention not only provides a substantial deterrent to theft and an excellent means of identifying stolen property, but also provides an excellent label system for tracking the location of movable goods in inventory.

While the present invention has been exemplified with reference to vehicles and their separable components, its utility in tracking and identifying virtually any goods or property having at least one painted metal surface is apparent. For example, in addition to car theft, an eminently suitable market for the present invention is the field of medical equipment.

Specifically, the present invention is ideally suited to use in medical equipment inventory management, the various disclosed embodiments providing a superior means of not only deterring theft, but also tracking inventory in a profession characterized by the need for rapid mobility of expensive medical equipment. Advantages to such a system include both tracking inventory and increasing the likelihood that equipment designated for use in particular areas or regions will not be removed therefrom. Additionally, the present invention can be employed to reduce the theft of leased medical equipment, while avoiding the need and expense of masking or camouflaging valuable equipment in leased and vulnerable locations.

As illustrated by the Example, the methods and label system of the present invention can advantageously form the basis for a system of inventory registry, even beyond the local and regional levels to the national level.

In sum, the present invention provides a method and system ideally suited to tracking the inventory and deterring the theft of any expensive equipment having painted or coated surfaces and a multitude of parts which are prone to being stolen, scavenged and re-sold either individually and/or separately.

We claim:

1. A label system for marking property, comprising:

at least one label and a backing element for supporting and transporting the at least one label prior to use;

each label comprising a thermal label stock layer having a front side and a rear side, the rear side having a non-release thermal adhesive layer thereon, the label stock and the non-release thermal adhesive layers being impregnated with a composition visible only when exposed to ultraviolet light and having apertures therethrough forming identifying indicia at a predetermined location, the identifying indicia relating to the property to be marked; and the backing element comprising a backing layer releasably-attaching each label thereto prior to use.

2. A label system according to claim 1, wherein the identifying indicia is a personal identification number unique to the owner of the property to be marked.

3. A label system according to claim 1, wherein the front side of the label stock layer has imprinted thereon information relating to the property to be marked.

4. A label system according to claim 3, wherein the imprinted information includes bar code information.

5. A method according to claim 4, wherein the bar code information includes the identifying indicia.

6. A label system according to claim 1, further comprising a topcoat on the front side of the label providing a protective seal for the label.

7. A label system according to claim 1, wherein the label further comprises a moisture-resistant and thermal-resistant liner laminated to the front side of the label stock layer.

8. A label system according to claim 1, comprising at least ten labels arranged on the backing element in discrete relation to each other.

9. A label system for marking property, comprising:

at least one label and a backing element for supporting and transporting the at least one label prior to use;

each label comprising a thermal label stock layer having a front side and a rear side, the front side having imprinted thereon a bar code containing information relating to the property to be marked and the rear side having a non-release thermal adhesive layer thereon, the label stock and non-release thermal adhesive layers being impregnated with a composition visible only when exposed to ultraviolet light; and the backing element comprising a backing layer releasably-attaching each label thereto prior to use.

10. A label system according to claim 9, wherein the bar code information comprises identifying indicia including a personal identification number unique to the owner of the property to be marked.

11. A label system according to claim 9, further comprising a topcoat on the front side of the label providing a protective seal for the label.

12. A label system according to claim 9, wherein the label further comprises a moisture-resistant and thermal-resistant liner laminated to the front side of the label stock layer.

13. A label system according to claim 9, comprising at least ten labels arranged on the backing element in discrete relation to each other.

14. A method for marking property having at least one painted or coated surface, comprising:

adhering at least one label to at least one metal surface of the property, each label comprising a thermal label stock layer having a front side and a rear side, the rear side having a non-release thermal adhesive layer thereon, the label stock and non-release thermal adhesive layers being impregnated with a composition visible only when exposed to ultraviolet light and having apertures therethrough forming identifying indicia at a predetermined location, the identifying indicia relating to the property to be marked; and allowing the ultraviolet-visible composition to migrate to substrata of the painted or coated surface, whereby the identifying indicia can be observed on the painted or coated surface should the label be removed from the painted or coated surface by exposing the painted or coated surface to ultraviolet light, thereby rendering visible the ultraviolet-visible composition and outlining the identifying indicia on the painted or coated surface.

15. A method according to claim 14, wherein the identifying indicia is a personal identification number unique to the owner of the marked property.

16. A method according to claim 14, wherein the front side of the label stock layer has imprinted thereon information relating to the property to be marked.

17. A method according to claim 16, wherein the imprinted information includes bar code information.

18. A method according to claim 17, wherein the bar code information includes the identifying indicia.

19. A method according to claim 14, further comprising applying a topcoat on the front side of the label to provide a protective seal for the label.

20. A method according to claim 14, further comprising adhering a plurality of the labels to a plurality of metal surfaces of the property, each of the metal surfaces being at least part of a separable component of the property.

21. A method for marking property having at least one metal surface, comprising:

adhering at least one label to at least one metal surface of the property, each label comprising a thermal label stock layer having a front side and a rear side, the front side having imprinted thereon a bar code containing information relating to the property to be marked and the rear side having a non-release thermal adhesive layer thereon, the label stock and non-release thermal adhesive layers being impregnated with a composition visible only when exposed to ultraviolet light; and allowing the ultraviolet-visible composition to migrate to substrata of the metal surface, whereby the information can first be detected by scanning the bar code while the label is adhered to the metal surface and thereafter the ultraviolet-visible composition can be detected on the metal surface should the label be removed from the metal surface by exposing the metal surface to ultraviolet light, thereby rendering visible the ultraviolet-visible composition on the metal surface.

22. A method according to claim 21, wherein the bar code information comprises identifying indicia including a personal identification number unique to the owner of the marked property.

23. A method according to claim 21, further comprising applying a topcoat on the front side of the label to provide a protective seal for the label.

24. A method according to claim 21, further comprising adhering a plurality of the labels to a plurality of metal surfaces of the property, each of the metal surfaces being at least part of a separable component of the property.

25. A method for making a label system for marking property, comprising:

providing a label sheet impregnated with a composition visible only when exposed to ultraviolet light, the label sheet comprising a label element and a backing element, the label element comprising a thermal label stock layer having a top side and a bottom side, the bottom side having a non-release thermal adhesive layer thereon, the backing element comprising a backing layer releasably-securing the label element thereto;

creating apertures from the top side through the bottom side of the label element at a plurality of predetermined locations on the label element to remove portions of the label element and the ultraviolet-visible composition and form identifying indicia through the label element; and dividing the label element into a plurality of discrete labels releasably-secured to the backing element, each label containing identifying indicia thereon.

26. A method according to claim 25, further comprising applying a topcoat to the label element to provide a protective seal for the label, including the identifying indicia apertures.

27. A method according to claim 25, further comprising imprinting the top side of the label element with information relating to the property to be marked.

28. A method according to claim 27, wherein the imprinting comprises ink-impregnating the top side of the label element to provide first information relating to the property to be marked, and then laser imprinting a bar code on the top side of the label element to provide bar code information.

29. A method according to claim 28, wherein the bar code information comprises the identifying indicia.

30. A method according to claim 27, wherein the information imprinted on the top side of the label element includes bar code information, the bar code information including the identifying indicia.

31. A method according to claim 25, wherein the identifying indicia is a personal identification number unique to the owner of the marked property.

32. A method for making a label system for marking property, comprising:

providing a label sheet impregnated with a composition visible only when exposed to ultraviolet light, the label sheet comprising a label element and a backing element, the label element comprising a thermal label stock layer having a top side and a bottom side, the bottom side having a non-release thermal adhesive layer thereon, the backing element comprising a backing layer releasably-securing the label element thereto;

imprinting the top side of the label element with a plurality of bar codes containing information relating to the property to be marked at a plurality of predetermined locations on the label element; and dividing the label element into a plurality of discrete labels releasably-secured to the backing element, each label containing a bar code thereon.

33. A method according to claim 32, further comprising applying a topcoat to the label element to provide a protective seal for each label, including the bar code.

34. A method according to claim 32, wherein the imprinting comprises ink-impregnating the top side of the label element to provide first information relating to the property to be marked, and then laser imprinting a bar code on the top side of the label element to provide bar code information.

35. A method according to claim 34, wherein the bar code information comprises identifying indicia including a personal identification number unique to the over of the marked property.

36. A method according to claim 32, wherein the bar code information comprises identifying indicia including a personal identification number unique to the owner of the marked property.

* * * * *